US010161348B1

(12) United States Patent
Shaw et al.

(10) Patent No.: US 10,161,348 B1
(45) Date of Patent: Dec. 25, 2018

(54) METHOD AND SYSTEM FOR FUEL CONTROL IN A VEHICLE PROPULSION SYSTEM

(71) Applicant: GM GLOBAL TECHNOLOGY OPERATIONS LLC, Detroit, MI (US)

(72) Inventors: Andrew M. Shaw, Fenton, MI (US); Rafat F Hattar, Royal Oak, MI (US); Matthew T Hamilton, Novi, MI (US)

( * ) Notice: Subject to any disclaimer, the term of this patent is extended or adjusted under 35 U.S.C. 154(b) by 0 days.

(21) Appl. No.: 15/658,489

(22) Filed: Jul. 25, 2017

(51) Int. Cl.
*F02M 1/00* (2006.01)
*F02D 41/30* (2006.01)
*F02D 41/38* (2006.01)

(52) U.S. Cl.
CPC ..... *F02D 41/3082* (2013.01); *F02D 41/3854* (2013.01); *F02D 2200/023* (2013.01); *F02D 2200/0602* (2013.01); *F02D 2200/0606* (2013.01)

(58) Field of Classification Search
CPC ..... F02D 41/3809; F02D 2200/0606; F02D 41/3845; F02D 2200/0602; F02M 63/0225; F02M 63/0265; F02M 37/0029; F02M 63/023
USPC ..... 123/445, 446, 453, 456, 457, 462–434; 701/101, 106
See application file for complete search history.

(56) References Cited

U.S. PATENT DOCUMENTS

| | | | | |
|---|---|---|---|---|
| 9,228,516 | B2 | 1/2016 | Kwapis et al. | |
| 9,567,915 | B2 | 2/2017 | Hattar et al. | |
| 2003/0178010 | A1* | 9/2003 | Pellizzari | F02D 41/003 123/549 |
| 2005/0211229 | A1* | 9/2005 | Pellizzari | F02D 41/003 123/525 |

* cited by examiner

*Primary Examiner* — John Kwon

(57) ABSTRACT

A fuel system for a vehicle propulsion system includes a fuel temperature determination module that determines a temperature of a fuel, a fuel pressure determination module that determines a pressure of the fuel, a prime determination module that determines whether the determined fuel temperature is above a vaporization temperature on a predetermined distillation curve and the fuel pressure is below the predetermined distillation curve at the determined fuel temperature, and a controller programmed to command operation of a fuel pump in response to the prime determination module determining that the determined fuel temperature is above a vaporization temperature on the predetermined distillation curve and the fuel pressure is below the predetermined distillation curve at the determined fuel temperature.

19 Claims, 4 Drawing Sheets

METHOD AND SYSTEM FOR FUEL CONTROL IN A VEHICLE PROPULSION SYSTEM

FIELD

The present disclosure relates to a method and system for fuel control in a vehicle propulsion system.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Internal combustion engines combust an air and fuel mixture within cylinders to drive pistons, which produces torque that may then be used to propel a vehicle in a vehicle propulsion system. A fuel system injects fuel into the engine system to provide a desired air/fuel mixture to the cylinders and/or to achieve a desired torque output. In the absence of a proper mixture, combustion may not be possible.

In some conditions, the fuel in the fuel system may absorb heat which may result in a portion of the fuel changing from a liquid phase to a vapor phase and a potential combination of liquid and vapor fuel in a fuel line of the fuel system. When this occurs, during an engine start procedure, an extended engine crank may result because a pump in the system, which is intended to provide the fuel to the engine at an appropriate rate and pressure, may fail to operate because the vaporized fuel may prevent that pump from operating correctly. This condition may be known as "vapor lock." Vapor lock may result in a disruption in the operation of a fuel pump that is intended to ensure a flow of fuel in the system. Once a vapor lock has occurred it can be difficult to restart the engine.

Certain conditions may be especially vulnerable to a potential problem. For example, when an engine in a vehicle is shut off, the heat in the engine may continue to "soak into" or transfer into the fuel in the fuel system. In response, the fuel may expand and cause a flow of fuel within the vehicle back toward the fuel tank, when the pressure of that fuel exceeds a check valve pressure. Subsequently, as the system cools off, the pressure in the system will decrease and, depending upon the volatility of the fuel, a portion of the fuel may vaporize. If a vehicle start is then attempted, the high pressure pump may experience an extended cranking interval until the fuel converts from vapor back to liquid, the pressure at the inlet to the high pressure pump returns and the higher pressure pump may then be able to provide sufficient fuel to enable a start. Because of the varying conditions experienced by the fuel system, the amount of time required to start may vary.

Conventional fuel supply systems may address this problem by priming or re-priming the fuel system every time a start is initiated and/or anticipated. However, the fuel in the fuel system may not always require priming or re-priming because the fuel might not be vaporized. Therefore, the energy that is expended to prime the fuel system may be unnecessary which leads to reduced performance, reduced durability, increased and undesirable noise, and reduced fuel efficiency.

These problems are further complicated by the variation in the quality and types of fuels that are available in the automotive market. Seasonal variations in fuel may also further complicate the problem. Winter fuels typically have higher volatility than summer fuels and the use of winter fuels in the summer time may result in increased susceptibility to these problems.

SUMMARY

In an exemplary aspect, a fuel system for a vehicle propulsion system includes a fuel temperature determination module that determines a temperature of a fuel, a fuel pressure determination module that determines a pressure of the fuel, a prime determination module that determines whether the determined fuel temperature is above a vaporization temperature on a predetermined distillation curve and the fuel pressure is below the predetermined distillation curve at the determined fuel temperature, and a controller programmed to command operation of a fuel pump in response to the prime determination module determining that the determined fuel temperature is above a vaporization temperature on the predetermined distillation curve and the fuel pressure is below the predetermined distillation curve at the determined fuel temperature.

In another exemplary aspect, an engine oil temperature sensor senses a temperature of engine oil in the vehicle propulsion system and the fuel temperature determination module estimates a temperature of the fuel based upon the engine oil temperature.

In another exemplary aspect, a coolant temperatures sensor senses a temperature of a coolant in the vehicle propulsion system and the fuel temperature determination module estimates a temperature of the fuel based upon the coolant temperature.

In another exemplary aspect, a fuel rail pressure sensor senses a temperature at the fuel rail pressure sensor and the fuel temperature determination module estimates a temperature of the fuel based upon the temperature at the fuel rail pressure sensor.

In another exemplary aspect, the fuel system further includes a fuel tank, a low pressure fuel pump having an inlet in communication with the fuel tank, a first fuel line in communication with an outlet of the low pressure fuel pump and in communication with an inlet of a high pressure fuel pump, and a second fuel line in communication with an outlet of the high pressure fuel pump an in communication with a fuel inlet of an engine in the vehicle propulsion system. The controller commands operation of the low pressure fuel pump in response to the prime determination module determining that the determined fuel temperature is above a vaporization temperature on the predetermined distillation curve and the fuel pressure is below the predetermined distillation curve at the determined fuel temperature.

In another exemplary aspect, a fuel pressure sensor senses a fuel pressure within the first fuel line and the fuel pressure determination module determines a pressure of the fuel based upon a fuel pressure signal from the fuel pressure sensor.

In another exemplary aspect, the predetermined distillation curve is offset below a distillation curve of an actual fuel by a predetermined amount.

In another exemplary aspect, the controller commands operation of the fuel pump to a pressure above the predetermined distillation curve in response to the prime determination module determining that the determined fuel temperature is above a vaporization temperature on the predetermined distillation curve and the fuel pressure is below the predetermined distillation curve at the determined fuel temperature.

In this manner, the fuel system is primed only in response to a determination that a fuel temperature is above a vaporization temperature of a predetermined fuel distillation curve and the fuel pressure is below the predetermined distillation curve at the determined fuel temperature which reduces the operation of a fuel pump which, in turn, reduces the amount of energy that would otherwise have been expended in operating that fuel pump thereby improving fuel efficiency, reducing wear and tear on the fuel pump, increasing the durability and reliability of the fuel pump while simultaneously minimizing the potential for a delayed engine start and/or extended engine crank condition.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
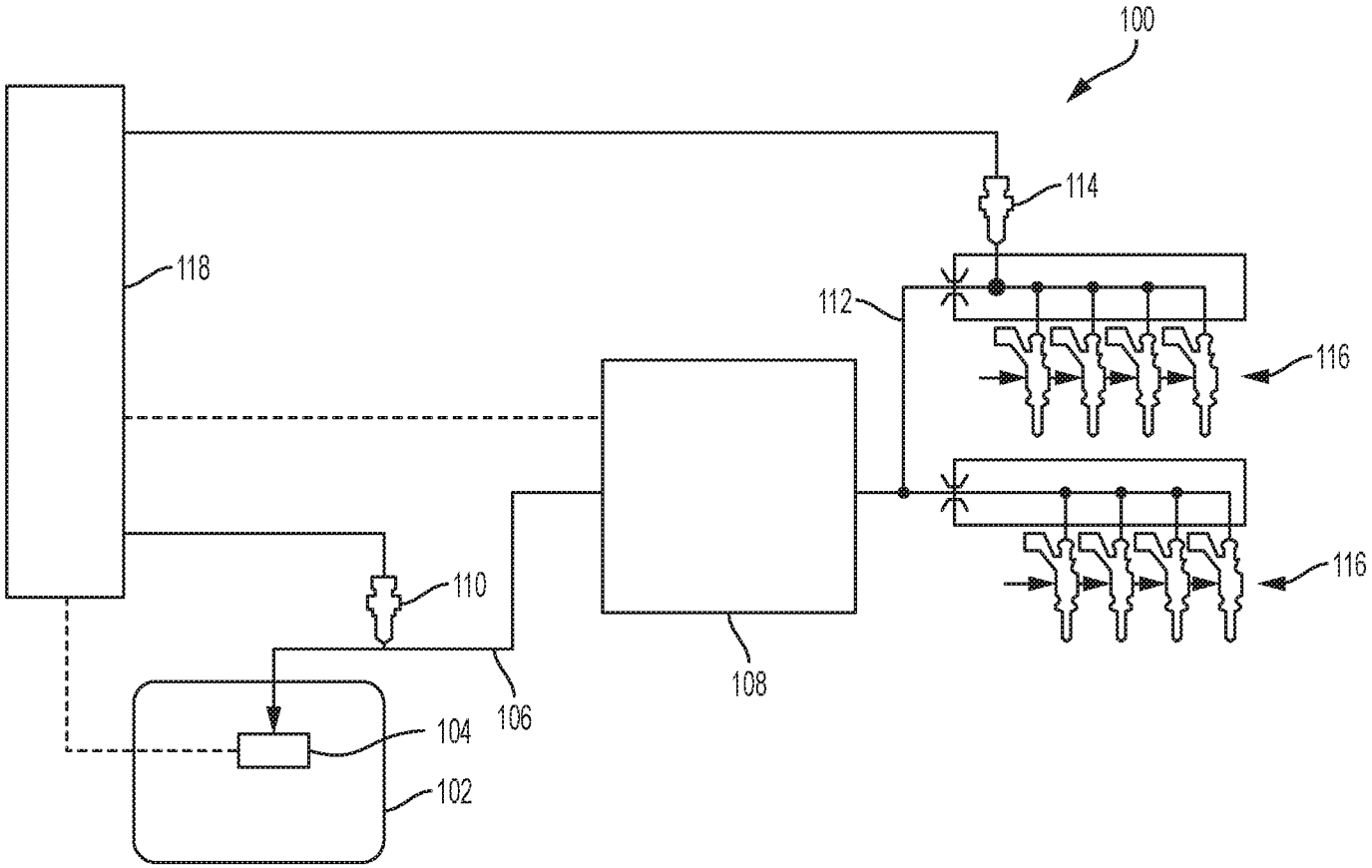
FIG. 1 illustrates an exemplary fuel system 100 for a vehicle propulsion system.

FIG. 1 illustrates an exemplary fuel system 100 for a vehicle propulsion system. The fuel system 100 includes a fuel tank 102 with a low pressure pump 104. The low pressure pump 104 is operable to provide fuel from the fuel tank 102 into a first fuel line 106. The first fuel line 106 extends from the low pressure pump 104 to a high pressure pump 108 and includes a first pressure sensor 110. The high pressure pump 108 receives fuel from the first fuel line 106 and operates to increase the pressure of the fuel and to provide that fuel at the higher pressure to a second fuel line 112. The second fuel line 112 may also be known as a fuel rail. The second fuel line 112 includes a second pressure sensor 114 and provides fuel from the high pressure fuel pump 108 to one or more fuel injectors 116. The fuel injectors 116 may operate to provide the fuel to an internal combustion engine (not shown) as is known in the art. The fuel system 100 further includes a fuel system controller 118. The fuel system controller 118 is in communication with each of the low pressure pump 104, the high pressure pump 108, and the fuel injectors 116 to control operation. The fuel system controller 118 is also in communication with the first pressure sensor 110 and the second pressure sensor 114 for receiving signals indicating fuel pressure at their corresponding locations within the fuel system 100. The fuel system controller 118 may also be in communication with other sensors such as, for example, an engine oil temperature sensor (not shown), a coolant temperature sensor (not shown), and the like without limitation.

Figure 2:
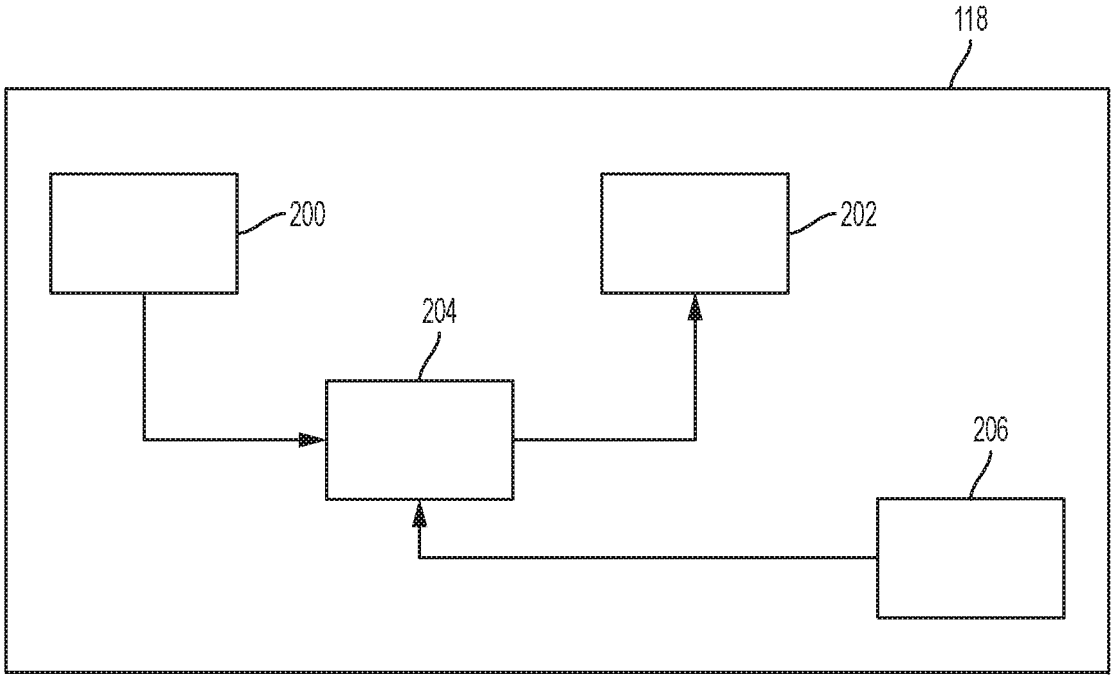
FIG. 2 is a functional block diagram of the fuel system controller 118 of FIG. 1.

FIG. 2 illustrates a functional block diagram representing an exemplary embodiment of the fuel system controller 118. The fuel system controller 118 includes a threshold distillation curve module 200 which stores a representation of a threshold distillation curve. The threshold distillation curve that is stored in the threshold distillation curve module 200 may take the form of a lookup table of values that provides a threshold temperature for each of a plurality of pressures. Alternatively, the threshold distillation curve representation may take the form of an equation, such as, for example, a quadratic equation that outputs a threshold temperature based upon an input pressure. The fuel system controller 118 may further include a low pressure pump controller 202, a comparison module 204, and a fuel temperature estimation module 206. The fuel temperature estimation module 206 may communicate with various sensors, such as, for example, an engine oil temperature sensor, a coolant temperature sensor, and the like to estimate a temperature of fuel. Alternatively, the fuel temperature estimation module 206 may be obviated by providing a temperature sensor (not shown) which may directly measure a temperature of the fuel.

In an exemplary embodiment, the fuel temperature estimation module 206 may receive temperature, fuel flow, and pressure signals and estimate a temperature of the fuel in the fuel system based upon those signals. For example, the fuel temperature estimation module 206 may calculate an estimated fuel temperature based upon the following:

$$Ft=(X*Ot)+(Y*Ct)+(Z*Ff) \quad (1)$$

Where: Ft is the estimated fuel temperature, Ot is an engine oil temperature, X is a coefficient relating the engine oil temperature to the estimated fuel temperature, Ct is a coolant temperature, Y is a coefficient relating coolant temperature to estimated fuel temperature, Ff is a fuel flow, and Z is a coefficient relating fuel flow to the estimated fuel temperature. The coefficients may be determined experimentally. The fuel temperature estimation module 206 sends the estimated fuel temperature to the comparison module 204. In response, the comparison module 204 compares the estimated fuel temperature to a boil point temperature on a predetermined fuel distillation curve based upon a given fuel pressure to determine whether that estimated fuel temperature is above the boil point temperature. If the comparison module 204 determines that the estimated fuel temperature is above the boil point temperature, then the comparison module 204 may send a prime signal to the low pressure pump controller 202 which, in response, actuates the low pressure pump.

Figure 3:
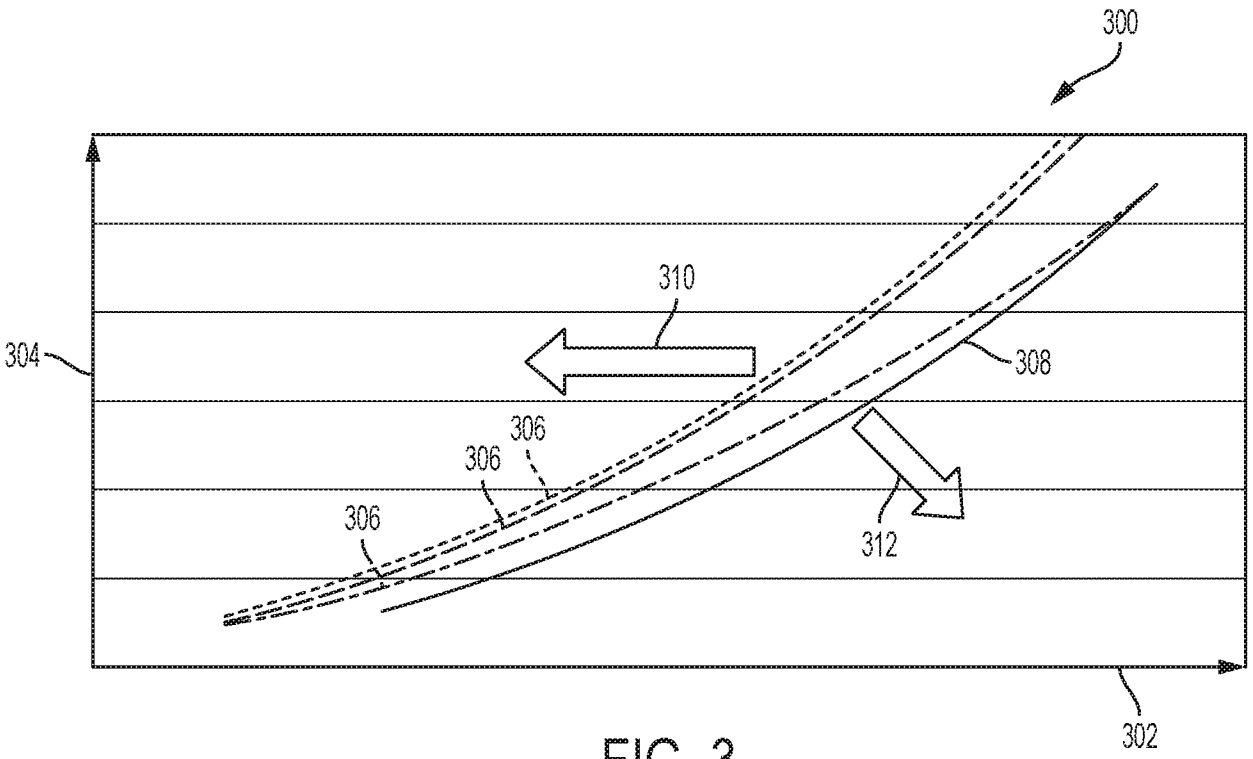
FIG. 3 is a graph illustrating exemplary fuel distillation curves.

Referring now to FIG. 3, the determination of a boil point temperature will be discussed in relation to exemplary fuel distillation curves. The graph 300 of FIG. 3 represents fuel pressure on the horizontal axis 302 and fuel temperature on the vertical axis 304. The graph 300 includes three exemplary fuel distillation curves 306 and a predetermined fuel distillation curve 308. Each of the three exemplary fuel distillation curves 306 illustrates a fuel distillation curve for each of a correspondingly different type of fuel. As explained previously, the fuels which are used in a vehicle propulsion system and which are available in the market for fueling vehicles may have varying properties. Each of those fuels having a different fuel distillation curve. For example, a summer type of fuel may have fuel distillation curve which has higher vaporization temperatures than that of a fuel distillation curve for a winter type of fuel. In the absence of knowledge of the actual fuel distillation curve for the fuel that is actually being provided to any given vehicle, an exemplary embodiment of the threshold distillation curve module 200 (see FIG. 2) may store a predetermined fuel distillation curve 308 which may approximate known fuel distillation curves of fuels which are available in the market. However, preferably the predetermined fuel distillation curve 308 may include vaporization temperatures which are generally lower than those which are known to be available in the market to ensure that priming appropriately occurs regardless of the fuel provided to any given vehicle. The predetermined fuel distillation curve 308 may be experimentally derived and may be offset a predetermined amount from any fuel distillation curves corresponding to fuels available in the market. In some instances, a "worst case" fuel distillation curve may be selected based upon known fuels available in the market and the predetermined fuel distillation curve may be selected to have an offset slightly lower than the "worst case" curve.

In general, given a fuel temperature and pressure, a fuel distillation curve may indicate whether the fuel may be in a vapor phase suspect state or not and a decision may then be made about whether a fuel pump should be actuated to prime the fuel system and return the fuel to a liquid phase. The area above any fuel distillation curve as indicated generally by arrow 310 indicates that any temperature and pressure that is located above a corresponding fuel distillation curve indicates that the fuel may be in a vapor phase suspect state. The area below any fuel distillation curve as indicated generally by arrow 312 indicates that any temperature and pressure that is located below a corresponding fuel distillation curve indicates that the fuel should be in a liquid phase and priming of the fuel system might not be necessary.

Figure 4:
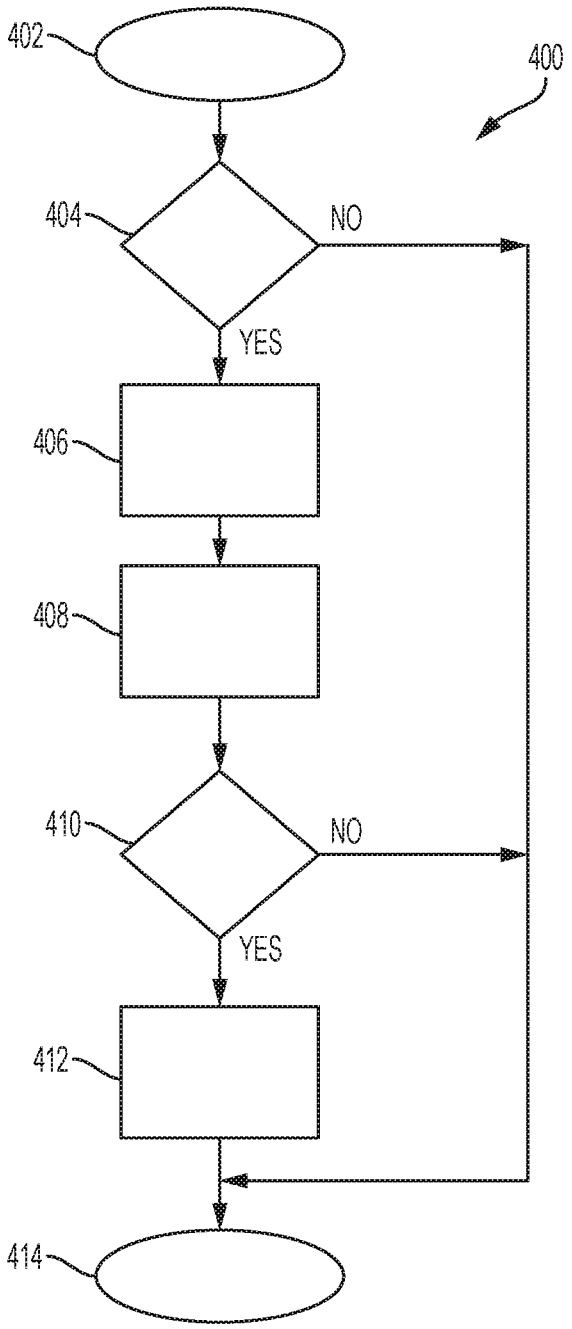
FIG. 4 is a flowchart of an exemplary method in accordance with the present invention.

FIG. 4 illustrates a flow chart 400 for an exemplary method in accordance with an exemplary embodiment of the present invention. The method starts at step 402 and continues to step 404. In step 404, the fuel system controller 118 determines whether a trigger event has occurred. If, in step 404, the fuel system controller 118 determines that a trigger event has occurred, then the method continues to step 406. In step 406, the fuel system controller 118 collects data representing conditions within the fuel system which may be relevant to determining whether a vapor phase suspect condition exists or not. For example, as explained above, the fuel system controller 118 may communicate with and receive signals from various sensors such as an engine oil temperature sensor, a coolant temperature sensor, a first pressure sensor 110, a second pressure sensor 112, a fuel flow signal (if available) and the like. The method then continues to step 408.

In step 408, the fuel temperature estimation module 206 estimates a fuel temperature based upon the available signals, and provides the estimated fuel temperature to the comparison module 204. The method then continues to step 410 where the comparison module 204 compares the estimate fuel temperature received from the fuel temperature estimation module 206 to a vaporization temperature on a predetermined fuel distillation curve 308, a representation of which is stored in the threshold distillation curve module 200. If, in step 410, the comparison module 204 determines that the estimated fuel temperature is above the corresponding vaporization temperature, then the method continues to step 412. In step 412, the comparison module 204 sends a prime command signal to the low pressure pump controller 202 which, in response, operates the low pressure pump 104 to prime the fuel system.

If, however, in step 404, the fuel system controller 118 determines that a trigger event has not occurred, or if in step 410, the comparison module 204 determines that the estimated fuel temperature is not above the vaporization temperature, then the method continues to step 414 where the method ends.

The trigger event referenced in the above discussion may take the form of any number of potential conditions. For example, a trigger event may correspond to a vehicle "wake up" where the vehicle may receive a signal that indicates that an engine start might be imminent such as some form of driver input that may be detected. In some instances, a vehicle may "wake up" in response to a door opening, a key input or the like without limitation. When the vehicle "wakes up" the system/method may then sense the relevant temperatures and pressures and make a determination whether a prime is necessary or not.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A fuel system for a vehicle propulsion system, the system comprising:

a fuel temperature determination module that determines a temperature of a fuel;

a fuel pressure determination module that determines a pressure of the fuel;

a prime determination module that determines whether the determined fuel temperature is above a vaporization temperature on a predetermined distillation curve and the fuel pressure is below the predetermined distillation curve at the determined fuel temperature; and a controller programmed to command operation of a fuel pump in response to the prime determination module determining that the determined fuel temperature is above a vaporization temperature on the predetermined distillation curve and the fuel pressure is below the predetermined distillation curve at the determined fuel temperature.

2. The fuel system of claim 1, further comprising an engine oil temperature sensor that senses a temperature of engine oil in the vehicle propulsion system, wherein the fuel temperature determination module estimates a temperature of the fuel based upon the engine oil temperature.

3. The fuel system of claim 1, further comprising a coolant temperatures sensor that senses a temperature of a coolant in the vehicle propulsion system, wherein the fuel temperature determination module estimates a temperature of the fuel based upon the coolant temperature.

4. The fuel system of claim 1, further comprising a fuel rail pressure sensor that senses a temperature at the fuel rail pressure sensor, wherein the fuel temperature determination module estimates a temperature of the fuel based upon the temperature at the fuel rail pressure sensor.

5. The fuel system of claim 1, further comprising:

a fuel tank;

a low pressure fuel pump having an inlet in communication with the fuel tank;

a first fuel line in communication with an outlet of the low pressure fuel pump and in communication with an inlet of a high pressure fuel pump; and a second fuel line in communication with an outlet of the high pressure fuel pump an in communication with a fuel inlet of an engine in the vehicle propulsion system, and wherein the controller commands operation of the low pressure fuel pump in response to the prime determination module determining that the determined fuel temperature is above a vaporization temperature on the predetermined distillation curve and the fuel pressure is below the predetermined distillation curve at the determined fuel temperature.

6. The fuel system of claim 5, further comprising a fuel pressure sensor that senses a fuel pressure within the first fuel line and wherein the fuel pressure determination module determines a pressure of the fuel based upon a fuel pressure signal from the fuel pressure sensor.

7. The fuel system of claim 1, wherein the predetermined distillation curve is offset below a distillation curve of an actual fuel by a predetermined amount.

8. The fuel system of claim 1, wherein the controller commands operation of the fuel pump to a pressure above the predetermined distillation curve in response to the prime determination module determining that the determined fuel temperature is above a vaporization temperature on the predetermined distillation curve and the fuel pressure is below the predetermined distillation curve at the determined fuel temperature.

9. A vehicle propulsion system for a vehicle, the vehicle propulsion system comprising:

an internal combustion engine;

a fuel rail in communication with the internal combustion engine;

a high pressure fuel pump having an outlet in communication with the fuel rail;

a fuel line in communication with an inlet of the high pressure fuel pump;

a low pressure fuel pump having an outlet in communication with the fuel line and having an inlet in communication with fuel tank;

a controller that is programmed to:

determine a temperature of the fuel;

determine a pressure of the fuel;

determine whether the determined fuel temperature is above a vaporization temperature on a predetermined distillation curve and the fuel pressure is below the predetermined distillation curve at the determined fuel temperature; and command operation of the low pressure fuel pump in response to the prime determination module determining that the determined fuel temperature is above a vaporization temperature on the predetermined distillation curve and the fuel pressure is below the predetermined distillation curve at the determined fuel temperature.

10. The vehicle propulsion system of claim 9, further comprising an engine oil temperature sensor that senses a temperature of engine oil in the vehicle propulsion system, wherein the fuel temperature determination module estimates a temperature of the fuel based upon the engine oil temperature.

11. The vehicle propulsion system of claim 9, further comprising a coolant temperatures sensor that senses a temperature of a coolant in the vehicle propulsion system, wherein the fuel temperature determination module estimates a temperature of the fuel based upon the coolant temperature.

12. The vehicle propulsion system of claim 9, further comprising a fuel rail pressure sensor that senses a temperature at the fuel rail pressure sensor, wherein the fuel temperature determination module estimates a temperature of the fuel based upon the temperature at the fuel rail pressure sensor.

13. The fuel system of claim 9, further comprising a fuel pressure sensor that senses a fuel pressure within the fuel line and wherein the fuel pressure determination module determines a pressure of the fuel based upon a fuel pressure signal from the fuel pressure sensor.

14. The fuel system of claim 9, wherein the predetermined distillation curve is offset below a distillation curve of an actual fuel by a predetermined amount.

15. The fuel system of claim 9, wherein the controller commands operation of the low pressure fuel pump to a pressure above the predetermined distillation curve in response to the prime determination module determining that the determined fuel temperature is above a vaporization temperature on the predetermined distillation curve and the fuel pressure is below the predetermined distillation curve at the determined fuel temperature.

16. A method for operating a vehicle propulsion system having an internal combustion engine, a fuel rail in communication with the internal combustion engine, a high pressure fuel pump having an outlet in communication with the fuel rail, a fuel line in communication with an inlet of the high pressure fuel pump, and a low pressure fuel pump having an outlet in communication with the fuel line and having an inlet in communication with fuel tank, the method comprising determining a temperature of the fuel;

determining a pressure of the fuel;

determining whether the determined fuel temperature is above a vaporization temperature on a predetermined distillation curve and the fuel pressure is below the predetermined distillation curve at the determined fuel temperature; and commanding operation of the low pressure fuel pump in response to the prime determination module determining that the determined fuel temperature is above a vaporization temperature on the predetermined distillation curve and the fuel pressure is below the predetermined distillation curve at the determined fuel temperature.

17. The method of claim 16, wherein the vehicle propulsion system further includes an engine oil temperature sensor that senses a temperature of engine oil in the vehicle propulsion system, and wherein estimating a temperature of the fuel is based upon the engine oil temperature.

18. The method of claim 16, wherein the vehicle propulsion system further includes a coolant temperatures sensor that senses a temperature of a coolant in the vehicle propulsion system, and estimating a temperature of the fuel is based upon the coolant temperature.

19. The method of claim 16, wherein the vehicle propulsion system further includes a fuel rail pressure sensor that senses a temperature at the fuel rail pressure sensor, wherein estimating a temperature of the fuel is based upon the temperature at the fuel rail pressure sensor.

* * * * *